US011749237B1

(12) United States Patent
Hearn et al.

(10) Patent No.: US 11,749,237 B1
(45) Date of Patent: Sep. 5, 2023

(54) SYSTEM AND METHOD FOR GENERATION OF MUSICAL NOTATION FROM AUDIO SIGNAL

(71) Applicant: STAFFPAD LIMITED, London (GB)

(72) Inventors: David William Hearn, London (GB); Matthew Tesch, Pittsburgh, PA (US)

( * ) Notice: Subject to any disclaimer, the term of this patent is extended or adjusted under 35 U.S.C. 154(b) by 0 days.

(21) Appl. No.: 18/061,036

(22) Filed: Dec. 2, 2022

(51) Int. Cl.
*G10G 1/04* (2006.01)
*G10H 1/00* (2006.01)

(52) U.S. Cl.
CPC ..... *G10G 1/04* (2013.01); *G10H 1/0008* (2013.01); *G10H 2210/061* (2013.01); *G10H 2210/066* (2013.01); *G10H 2210/076* (2013.01); *G10H 2210/081* (2013.01); *G10H 2210/086* (2013.01)

(58) Field of Classification Search
CPC .. G10G 1/04; G10H 1/0008; G10H 2210/061; G10H 2210/066; G10H 2210/076; G10H 2210/081; G10H 2210/086
See application file for complete search history.

(56) References Cited

FOREIGN PATENT DOCUMENTS

CN 111429940 B * 10/2020

* cited by examiner

*Primary Examiner* — Jianchun Qin
(74) *Attorney, Agent, or Firm* — RC Trademark Company

(57) ABSTRACT

A system for generation of a musical notation from an audio signal, the system comprising at least one processor configured to: obtain the audio signal from an audio source or a data repository; process the audio signal using first machine learning (ML) model(s) to generate a recognition result, wherein the recognition result is indicative of a pitch and a duration of a plurality of notes in the audio signal and their corresponding confidence scores; generate a preliminary musical notation using the recognition result; process the preliminary musical notation using second ML model(s) to determine whether the preliminary musical notation includes one or more errors; and when it is determined that the preliminary musical notation includes one or more errors, modify the preliminary musical notation to generate the musical notation that is error-free or has lesser errors as compared to the preliminary musical notation.

11 Claims, 2 Drawing Sheets

SYSTEM AND METHOD FOR GENERATION OF MUSICAL NOTATION FROM AUDIO SIGNAL

TECHNICAL FIELD

The present disclosure relates to processing of audio signals. In particular, though not exclusively, this disclosure relates to a system for generation of musical notation from audio signals. The present disclosure also relates to a method for the generation of musical notation from audio signals.

BACKGROUND

Musical notations are crucial to perform musical compositions. Musical notations may provide detailed information to artists to accurately perform the musical compositions on various instruments. The information may include what notes to play, how fast or slow to play the notes, and the like. The musical notations can be generated using various methods. The methods may include inputting notes of a musical performance using a keyboard, inputting the notes using a musical instrument digital interface (MIDI) keyboard, inputting the notes using a mouse, writing the notes manually, and the generation of the musical notations from an audio input using machine learning (ML) model.

However, conventional systems and methods do not produce desirable results. There are several problems associated with the conventional systems or methods. Firstly, the musical notations generated using the conventional system or method are often difficult to read owing to an overly literal transcription of the audio input. Timing and/or performance mistakes often obscure representation of the audio input, even if pitch and/or time detection is accurate. Secondly, conventional methods to clean up the resulting MIDI information of the audio input rely on simple quantizers, which are inefficient. Thirdly, generation of the musical notations depend upon audio recognition methods. The audio recognition method is usually performed offline as a standalone process, wherein an audio is converted to a MIDI file, then the MIDI file is converted into the musical notation. However, this leads to a state where the musical notation cannot be easily edited. Fourthly, the conventional systems and methods may not produce audio waveform with the musical notation. Further, the conventional system and method do not allow to record a live musical performance and/or convert it into the musical notations in near real time.

Therefore, in light of the foregoing discussion, there exists a need to overcome the aforementioned drawbacks associated with existing systems and methods for generating the musical notation.

SUMMARY

A first aspect of the present disclosure provides a system for generation of a musical notation from an audio signal, the system comprising at least one processor configured to:

- obtain the audio signal from an audio source or a data repository;
- process the audio signal using at least one first machine learning (ML) model to generate a first recognition result, wherein the recognition result is indicative of a pitch and a duration of a plurality of notes in the audio signal and their corresponding confidence scores;
- generate a preliminary musical notation using the first recognition result;

- process the preliminary musical notation using at least one second ML model to determine whether the preliminary musical notation includes one or more errors; and
- when it is determined that the preliminary musical notation includes one or more errors, modify the preliminary musical notation to generate the musical notation that is error-free or has lesser errors as compared to the preliminary musical notation.

The term "musical notation" refers to a set of visual instructions comprising different symbols representing the plurality of notes of the audio signal on a musical staff. The musical notation of the audio signal can be used by an artist to perform a certain music.

The term "processor" refers to a computational element that is operable to respond to and process instructions. Furthermore, the term "processor" may refer to one or more individual processors, processing devices and various elements associated with a processing device that may be shared by other processing devices. Such processors, processing devices and elements may be arranged in various architectures for responding to and executing processing steps. The at least one processor is configured to execute at least one software application for implementing at least one processing task that the at least one processor is configured for.

The at least one software application could be a single software application or a plurality of software applications. The at least one software application helps to receive the audio signal and/or modify the preliminary musical notation to generate the musical notation. Optionally, the at least one software application is installed on a remote server. Optionally, the at least one software application is accessed by a user device associated with a user, via a communication network. It will be appreciated that the communication network may be wired, wireless, or a combination thereof. The communication network could be an individual network or a combination of multiple networks. Examples of the communication network may include, but are not limited to one or more of, Internet, a local network (such as, a TCP/IP-based network, an Ethernet-based local area network, an Ethernet-based personal area network, a Wi-Fi network, and the like), Wide Area Networks (WANs), Metropolitan Area Networks (MANs), a telecommunication network, and a short-range radio network (such as Bluetooth®). Examples of the user device include, but are not limited to, a laptop, a desktop, a tablet, a phablet, a personal digital assistant, a workstation, a console.

Notably, the at least one processor receives the audio signal from the audio source. The term "audio signal" refers to a sound. The audio signal may include one or more of speech, instrumental music sound, vocal musical sound, and the like. In an embodiment, the audio signal is the instrumental music sound of one or more musical instruments.

Optionally, the audio signal is one of: a monophonic signal, a polyphonic signal. In one implementation, the audio signal may be the monophonic signal. The term "monophonic signal" refers to the sound comprising a single melody, unaccompanied by any other voices. In one example, the monophonic signal may be produced by a loudspeaker. In another example, the monophonic signal may be produced by two different instruments playing a same melody. The term "polyphonic signal" refers to the sound produced by multiple audio sources at the given time. For example, the polyphonic signal may include different melody lines produced using different instruments at a given time.

Optionally, when obtaining the audio signal from the audio source, the at least one processor is configured to record the audio signal when the audio signal is played by the audio source or import a pre-recorded audio file from the data repository. The term "audio source" refers to a physical source of the audio signal and/or a recording configuration. Examples of the audio source could be a microphone, a speaker, a musical instrument, and the like. In an embodiment, the audio source is the musical instrument. Examples of the musical instrument could be, piano, violin, guitar, or the similar. In one implementation, the at least one processor may receive the audio signal directly from the audio source. In said implementation, the audio source could be the musical instrument. For example, music may be played on the piano and may be received by the at least one processor in real time. Optionally, the audio signal is recorded using at least one tool, for example, an audio metronome. The aforesaid tool may be set at a specific tempo (or speed) to enable the system to accurately record the audio signal.

In another implementation, the at least one processor may import the pre-recorded audio file from the data repository. The at least one first processor is communicably coupled to the data repository. It will be appreciated that the data repository could be implemented, for example, such as a memory of a given processor, a memory of the computing device communicably coupled to the given processor, a removable memory, a cloud-based database, or similar. Optionally, the pre-recorded audio file is saved on the computing device at the data repository. Optionally, the pre-recorded audio file is imported into the at least one software application. The pre-recorded audio file may be imported using the computing device by at least one of: a click input, a drag input, a digital input, a voice command. Advantageously, the aforesaid approaches for obtaining the audio file are very easy to perform and results in accurately receiving the audio signal.

Notably, the at least one processor processes the audio signal using the at least one first machine learning (ML) model. Optionally, the at least one processor is further configured to:

generate a first training dataset that is to be employed to train the at least one first ML model, wherein the first training dataset comprises at least one of: audio signals generated by at least one musical instrument, metadata of the audio signals generated by the at least one musical instrument; and train the at least one first ML model using the first training dataset and at least one ML algorithm.

In this regard, the at least one processor generates the first training dataset prior to processing the audio signal using the at least one first ML model. In a first implementation, the first training dataset may comprise the audio signals generated by the at least one musical instrument. Optionally, the at least musical instrument includes a plurality of musical instruments. A number of the at least one musical instrument may be crucial to determine performance of the at least one first ML model, since a high number of the at least one musical instrument enables in improving the performance of the at least one first ML model.

In a second implementation, the first training dataset may comprise metadata of the audio signals generated by the at least one musical instrument. The term "metadata" refers to data that provides information about the audio signals (for example, the pitch and duration of the audio signals) generated by the at least one musical instrument. Example of the metadata could be a musical instrument digital interface (MIDI) file.

In a third implementation, the first training dataset may comprise the first training dataset and the metadata of the audio signals generated by the at least one musical instrument. In said implementation, the first training dataset may comprise a plurality of musical performances of the plurality of musical instruments with corresponding MIDI files of the musical performances. In an example, the first training dataset may be generated using a digital player piano. The digital player piano is set up to self-record thousands of hours of the plurality of musical performances artificially generated and/or derived from the plurality of existing MIDI files.

Notably, upon generation of the first training dataset, the at least one first (ML) model is trained using the at least one ML algorithm. Advantageously, the aforesaid first training dataset provides significant advantages over known dataset. Example of the known dataset could be MAESTRO (MIDI and Audio Edited for Synchronous Tracks and Organization) dataset. The MAESTRO dataset comprises musical performances played by students in musical competitions. Therefore, the MAESTRO dataset comprises overly complex musical performances (as the students focus on technical virtuosity) rather than real-world examples. The first training dataset provides far detailed and/or specific training scenarios which significantly increases accuracy of the generation of the musical notation from the audio signal.

Optionally, the at least one first ML model comprises a plurality of first ML models and the first training dataset comprises a plurality of subsets, each subset comprising at least one of: audio signals generated by one musical instrument, metadata of the audio signals generated by the one musical instrument, wherein each first ML model is trained using a corresponding subset. In this regard, one subset of the plurality of subsets comprises the audio signals and/or the metadata of a specific instrument. In one example, one subset of the plurality of subsets may include the audio signal generated by the piano and a corresponding MIDI file of the audio signal. In another example, one subset of the plurality of subsets may include the audio signal generated by the guitar and the corresponding MIDI file of the audio signal. The plurality of first ML models may be trained for the plurality of subsets. In other words, one set of the plurality of first ML models may be trained for a specific subset of the first training dataset. In one example, one first ML model may be trained for one subset of the first training dataset comprising audio signals of piano. In another example, two of the first ML models may be trained for two subsets of the first training dataset, such that one subset may have audio signals of guitar, other subset may have the MIDI file of the audio signal of the guitar. Herein, the at least one first ML model used to process the audio signal may depend upon the audio signal. In one example, the at least one first ML model trained on the guitar may be used to transcribe the audio signal of the guitar. Advantageously, the technical effect of this is that the audio signal can be accurately transcribed to generate the musical notation.

Notably, the at least one processor processes the audio signal to identify the pitch and the duration of the plurality of notes in the audio signal. The "pitch" of a note refers to a frequency of the note. Higher the frequency, the higher the pitch and vice versa. The note may have different pitches in different octaves. As one example, on a regular piano, a note C may have one of pitches: 32.70 Hz, 65.41 Hz, 130.81 Hz, 261.63 Hz, 523.25 Hz, 1046.50 Hz, 2093.00 Hz, 4186.01 Hz. As another example, a note A may have one of pitches: 55 Hz, 110 Hz, 220 Hz, 440 Hz, 880 Hz, 1760 Hz, 3520 Hz, 7040 Hz.

The "duration" of a note refers to a length of a time that the note is played. Depending upon the duration, the plurality of notes may be categorized as at least one of: whole notes, half notes, quarter notes, eighth notes, sixteenth notes.

Optionally, prior to processing the audio signal using the at least one first ML model, the at least one processor is further configured to convert the audio signal into a plurality of spectrograms having a plurality of time windows. The plurality of time windows may be different from each other. In this regard, the term "spectrogram" refers to a visual way of representing frequencies in the audio signal over a time. Optionally, the plurality of spectrograms are a plurality of Mel spectrograms. The term "Mel spectrogram" refers to a spectrogram that is converted to a Mel scale. Optionally, the audio signal is converted into the spectrogram using Fourier Transforms. A Fourier transform may decompose the audio signal into its constituent frequencies and display an amplitude of each frequency present in the audio signal over time. As an example, the spectrogram may be a graph, having a plurality of frequencies on a vertical axis, a time on a horizontal axis. In said example, a plurality of amplitudes over the time may be represented by various colors on the graph. Optionally, to obtain a near real-time transcription of the audio signal, the plurality of first ML models are run simultaneously (i.e., parallel to each other) which utilize the plurality of time windows. In this regard, the spectrogram having a shortest time window can be processed by the at least one first ML model and/or is transcribed into the musical notation at first. Next, the spectrogram having a comparatively longer time window is processed by the at least one first ML model. Optionally, the musical notation produced using the spectrogram having the longer time window is more accurate and/or replaces the musical notation produced using the spectrogram having the shortest time window. Advantageously, the technical effect of spectrogram is that it enables distinguishing noise from the audio signal for accurate interpretation of the audio signal.

Next, upon generation of the plurality of spectrograms, the at least one processor feeds the plurality of spectrograms to the at least one first ML model. The at least one first ML model may ingest the plurality of spectrograms having the plurality of time windows (that may be varying with respect to each other) optionally depending upon at least one of: a desired musical notation of the audio signal, operating mode, musical context. Notably, the at least one processor determines the pitch and the duration of the plurality of notes from plurality of spectrograms using the at least one first ML model. The at least one first ML model could, for example, be a Convolutional Neural Network (CNN) model.

Optionally, the pitch and the duration of the plurality of notes in the recognition result is represented in a form of a list. Optionally, the recognition result is stored in the data repository. Notably, the pitch and the duration of the plurality of notes are associated with respective confidence scores. Optionally, the confidence scores lie in a range of 0 to 1. Alternatively, optionally, the confidence scores lie in a range of −1 to +1. Yet alternatively, optionally, the confidence scores lie in a range of 0 to 100. Other ranges for confidence scores are also feasible.

Next, the at least one processor generates the preliminary musical notation using the recognition result. In this regard, Optionally, the at least one processor uses the pitch and the duration in the recognition result to represent the plurality of notes on the musical staff. Generation of musical notations from the pitch and the duration of the plurality of notes is well-known in the art.

Next, the at least one processor processes the preliminary musical notation using the at least one second ML model. Optionally, the at least one second ML model include a plurality of second ML models. Optionally, the preliminary musical notation of the audio signal produced by a specific instrument may be processed by a specific second ML model trained for the specific instrument. Optionally, the second training data set comprises the plurality of audio signals of a plurality of musical compositions.

Optionally, the at least one processor is further configured to detect a change in at least one of: a time signature of the preliminary musical notation, a key signature of the preliminary musical notation, a tempo marking of the preliminary musical notation, a type of the audio source, wherein upon detection of the change, the at least one processor triggers the processing of the preliminary musical notation using the at least one second ML model. In other words, one or more of the aforesaid conditions triggers error-checking of the preliminary musical notation using the at least one second ML model. In this regard, the term "time signature" refers to a notational convention in the musical notation. The time signature may divide the musical notation into a plurality of phrases. In one example, the at least one processor may detect the change in the time signature of the preliminary musical notation. As an example, the time signature of the preliminary musical notation may change from 3/4 to 4/2. The time signature of 3/4 may indicate that there are three quarter notes in each phrase of musical notation. The time signature of 4/2 may indicate that there are four half notes in each phrase of the musical notation.

In another example, the at least one processor may detect the change in the key signature of the preliminary musical notation. The term "key signature" refers to an arrangement of sharp and/or flat signs on lines of a musical staff. The key signature may indicate notes in every octave to be raised by sharps and/or lowered by flats from their normal pitches.

In yet another example, the at least one processor may detect the change in the tempo marking of the preliminary musical notation. The term "tempo marking" refers to a number of beats per unit of time. Optionally, the change in the tempo marking may indicate the change in the number of beats. As an example, the tempo marking may change from 60 Beats per minute (BPM) to 120 BPM.

In still another example, the at least one processor may detect the change in the audio source. The change in the audio source may be detected as the change in the musical instrument from which the audio signal is played. As an example, the audio signal may be played using the piano and using the guitar. Notably, upon detecting the change in the preliminary musical notation, the at least processor initiates processing of the preliminary musical notation. Advantageously, the technical effect of detection of the aforesaid changes may enhance accuracy in transcription of the audio signal into the musical notation.

Notably, the at least one processor processes the preliminary musical notation to determine the one or more errors. The term "error" refers to an incorrect pitch and/or an incorrect duration associated with at least one note amongst the plurality of notes. Optionally, the one or more errors are identified to accurately transcribe the audio signal into the musical notation.

The present disclosure provides a system for generation of the musical notation from the audio signal. Beneficially, the at least one first ML model is tailored to process the audio signal of a specific instrument. For example, one of the at least one first ML model may be trained for piano and other of the at least one first ML model may be trained for violin.

Therefore, the audio signal of the specific instrument is processed by the at least one first ML model trained for the specific instrument, thereby ensuring high accuracy in generation of the musical notation from the audio signal. Additionally, the system allows for real time recording of the audio signal and/or generation of the musical notation from the audio signal. Beneficially, the musical notation can be easily viewed in near real time and/or edited (i.e., corrected) to reduce the one or more errors. Moreover, the system of the present disclosure identifies and/or helps remove mistakes in the audio signal related to timing.

Optionally, when processing the preliminary musical notation using the at least one second ML model, the at least one processor is configured to:

identify at least one phrase in the audio signal, based on a plurality of phrases in a plurality of audio signals belonging to a second training dataset using which the at least one second ML model is trained, wherein the at least one phrase comprises a sequence of notes that occurs between two rests;

determine whether a pitch and/or a duration of the sequence of notes in the at least one phrase mis-match with a pitch and/or a duration of notes in one or more of the plurality of phrases; and determine that the preliminary musical notation includes the one or more errors, when it is determined that the pitch and/or the duration of the sequence of notes in the at least one phrase mis-match with the pitch and/or the duration of notes in one or more of the plurality of phrases.

In this regard, optionally, the phrase is a short section of a musical composition comprising the sequence of notes. The audio signal may have a plurality of phrases. Optionally, a number of the at least one phrase identified by the at least one second ML model may depend upon a number of the plurality of phrases present in the audio signal. In a first example, the audio signal may have four phrases. In said example, the at least one second ML model may identify four phrases. Optionally, the at least one second ML model identifies at least one chord in the audio signal.

Optionally, the at least one processor determines the pitch and/or the duration of the sequence of notes present in the at least one phrase of the audio signal. Optionally, the at least one processor determines the pitch and/or duration of the sequence of notes represented in the preliminary musical notation. Optionally, the at least one processor determines the pitch and/or the duration of the sequence of notes in the at least one phrase using at least one second ML model.

Optionally, the at least one processor compares the pitch and/or the duration of the at least one phrase in the audio signal with the pitch and/or duration of the one or more of the plurality of phrases belonging to the second training dataset. Referring to the first example, the at least one processor may compare the pitch and/or the duration of all the notes in the four phrases with the pitch and/or the duration of the one or more of the plurality of phrases belonging to the second training dataset. Optionally, the at least one processor compares the pitch and/or the duration using the at least one second ML model.

Next, the at least one processor determines whether the pitch and/or the duration of the sequence of notes in the at least one phrase is similar or different from the pitch and/or duration of the notes in the one or more of the plurality of phrases. The pitch and/or the duration of any two notes is said to be similar, when the pitch and/or duration of one note lies in a range of 70 percent to 100 percent of the pitch and/or the duration of another note. For example, the pitch and/or the duration of one note may lie in a range of 70 percent, 75 percent, 80 percent, or 90 percent up to 80 percent, 90 percent, 95 percent or 100 percent of the pitch and/or the duration of another note. The pitch and/or the duration of the two notes is said to be mismatched when the pitch and/or the duration of the two notes lies beyond the aforesaid range. Notably, based upon the mis-match, the at least one processor determines that the preliminary musical notation includes one or more errors. The higher the mis-match (i.e., the more the instances of mis-matching), the more the number of errors are. Advantageously, the at least one processor is able to accurately determine the one or more errors in the preliminary musical notation in less time.

Notably, upon determining the one or more errors in the preliminary musical notation, the at least one processor modifies the preliminary musical notation. Optionally, the preliminary musical notation is modified to reduce the one or more errors. Optionally, the at least one processor modifies the preliminary musical notation using the at least one second ML model.

Optionally, when modifying the preliminary musical notation to generate the musical notation that is error-free or has lesser errors as compared to the preliminary musical notation, the at least one processor is configured to:

determine a required correction in the pitch and/or the duration of the sequence of notes in the at least one phrase, based on an extent of mis-match between the pitch and/or the duration of the sequence of notes in the at least one phrase and the pitch and/or the duration of notes in one or more of the plurality of phrases; and apply the required correction to the pitch and/or the duration of the sequence of notes in the at least one phrase.

In this regard, the term "extent of mis-match" refers to a difference of the pitch and/or the duration between any two notes in the audio signal and the second training dataset, respectively. Moreover, the extent of mis-match could be a number of notes which are different between any two phrases in the audio signal and the second training dataset, respectively.

As one example, a note A in the audio signal may have the pitch of 65 Hz and a note A in the second training dataset may have the pitch of 55 Hz. As another example, a phrase in the audio signal may have two notes which have different pitches then the notes of a phrase in the second training dataset. Optionally, the required correction depends upon the extent of the mis-match. Higher the extent of the mis-match, the higher the required correction is.

Optionally, the at least one processor compares the at least one note amongst the sequence of notes in the at least one phrase and the notes in the one or more of the plurality of phrases. Optionally, the at least one processor applies the required correction by way of: replacing a given note with a correct note on the musical staff, correcting position of a given note on the musical staff. For example, the at least one processor may replace a note C4 in the at least one phrase with C5 based upon the one or more of the plurality of phrases. Advantageously, the at least one processor accurately determines the required correction to obtain the musical notation which is significantly error-free.

Optionally, when it is determined that the pitch and/or the duration of the sequence of notes in the at least one phrase match with the pitch and/or the duration of notes in one or more of the plurality of phrases, the at least one processor is configured to:

determine whether confidence scores associated with the pitch and/or the duration of the sequence of notes in the at least one phrase lie below a confidence threshold; and when it is determined that the confidence scores associated with the pitch and/or the duration of the sequence of notes in the at least one phrase lie below the confidence threshold, update the confidence scores to be greater than the confidence threshold.

Optionally, a value of the confidence threshold lies in a range of 50 percent to 90 percent of a highest possible confidence value. For example, the value of the confidence threshold may lie in a range of 50 percent, 55 percent, 65 percent, or 75 percent up to 60 percent, 75 percent, 85 percent or 90 percent of the highest possible confidence value.

Optionally, the at least one processor increases the confidence score of the sequence of notes having the confidence score less than the aforesaid range but having the similar pitch and/or the duration. The low confidence score of the pitch and/or the duration may indicate low performance of the at least one first ML model.

Advantageously, the technical effect of updating the confidence scores is that performance of at least one first ML model is significantly improved which results in significant improvement in accuracy for determination of the pitch and the duration of audio signal.

Optionally, the at least one processor is further configured to:

generate a preliminary audio waveform of the audio signal using the recognition result; and modify the preliminary audio waveform to generate an audio waveform that is error-free or has lesser errors as compared to the preliminary audio waveform.

In this regard, the term "audio waveform" refers to a visual way of representing amplitudes of the audio signal with respect to time. The audio waveform is a graphical representation which includes amplitude on a vertical axis and the time on a horizontal axis. Optionally, the preliminary audio waveform is generated from the recognition result.

Optionally, the at least one processor processes the preliminary audio waveform to reduce the one or more errors present in the preliminary audio waveform to generate the audio waveform. Optionally, the preliminary audio waveform is modified using the at least one second ML model. Alternatively, optionally, the preliminary audio waveform is modified based on the one or more errors in the preliminary musical notation.

Optionally, the audio signal is toggled simultaneously between the audio waveform and the musical notation. In this regard, differences between the audio signal and the musical notation are compared and/or corrected as per the process described for the musical notation.

A second aspect of the present disclosure provides a method for generating a musical notation from an audio signal, the method comprising:

obtaining the audio signal from an audio source or a data repository;

processing the audio signal using at least one first machine learning (ML) model for generating a first recognition result, wherein the recognition result is indicative of a pitch and a duration of a plurality of notes in the audio signal and their corresponding confidence scores;

generating a preliminary musical notation using the first recognition result;

processing the preliminary musical notation using at least one second ML model to determine whether the preliminary musical notation includes one or more errors; and upon determining that the preliminary musical notation includes one or more errors, modifying the preliminary musical notation for generating the musical notation that is error-free or has lesser errors as compared to the preliminary musical notation.

The method steps for generation of the musical notation from the audio signal are already described above. Advantageously, the aforesaid method is easy to implement, provides fast results, and does not require expensive equipment.

Optionally, the step of processing the preliminary musical notation using the at least one second ML model comprises:

identifying at least one phrase in the audio signal, based on a plurality of phrases in a plurality of audio signals belonging to a second training dataset using which the at least one second ML model is trained, wherein the at least one phrase comprises a sequence of notes that occurs between two rests;

determining whether a pitch and/or a duration of the sequence of notes in the at least one phrase mis-match with a pitch and/or a duration of notes in one or more of the plurality of phrases; and determining that the preliminary musical notation includes the one or more errors, when it is determined that the pitch and/or the duration of the sequence of notes in the at least one phrase mis-match with the pitch and/or the duration of notes in one or more of the plurality of phrases.

Optionally, the step of modifying the preliminary musical notation for generating the musical notation that is error-free or has lesser errors as compared to the preliminary musical notation comprises:

determining a required correction in the pitch and/or the duration of the sequence of notes in the at least one phrase, based on an extent of mis-match between the pitch and/or the duration of the sequence of notes in the at least one phrase and the pitch and/or the duration of notes in one or more of the plurality of phrases; and applying the required correction to the pitch and/or the duration of the sequence of notes in the at least one phrase.

Optionally, the method further comprises detecting a change in at least one of: a time signature of the preliminary musical notation, a key signature of the preliminary musical notation, a tempo marking of the preliminary musical notation, a type of the audio source, wherein upon detecting the change, triggering the processing of the preliminary musical notation using the at least one second ML model.

Optionally, the method further comprises:

generating a first training dataset that is to be employed for training the at least one first ML model, wherein the first training dataset comprises at least one of: audio signals generated by at least one musical instrument, metadata of the audio signals generated by the at least one musical instrument; and training the at least one first ML model using the first training dataset and at least one ML algorithm.

BRIEF DESCRIPTION OF THE DRAWINGS

One or more embodiments of the present disclosure will now be described, by way of example only, with reference to the following diagrams wherein.

DETAILED DESCRIPTION

Figure 1:
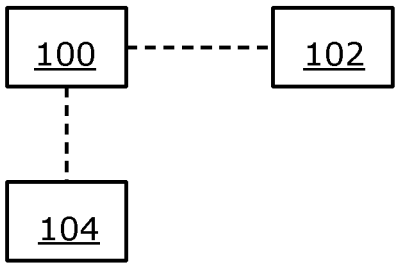
FIG. 1 illustrates a network environment in which a system for generation of a musical notation from an audio signal can be implemented, in accordance with an embodiment of the present disclosure.

Referring to FIG. 1, illustrated is a network environment in which a system 100 for generation of a musical notation from an audio signal can be implemented, in accordance with an embodiment of the present disclosure. The network environment comprises the system 100, an audio source 102 and a data repository 104. The system 100 is communicatively coupled to the audio source 102 and the data repository 104.

Figure 2:
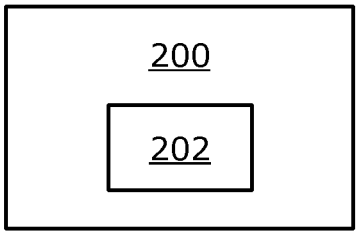
FIG. 2 is a block diagram representing a system for generation of a musical notation from an audio signal, in accordance with an embodiment of the present disclosure.

Referring to FIG. 2, illustrated is a block diagram representing a system 200 for generation of a musical notation from an audio signal, in accordance with an embodiment of the present disclosure. The system 200 comprises at least one processor (depicted as a processor 202), which is configured to generate the musical notation from the audio signal.

FIGS. 1 and 2 are merely examples, which should not unduly limit the scope of the claims herein. A person skilled in the art will recognize many variations, alternatives, and modifications of embodiments of the present disclosure.

Figure 3:
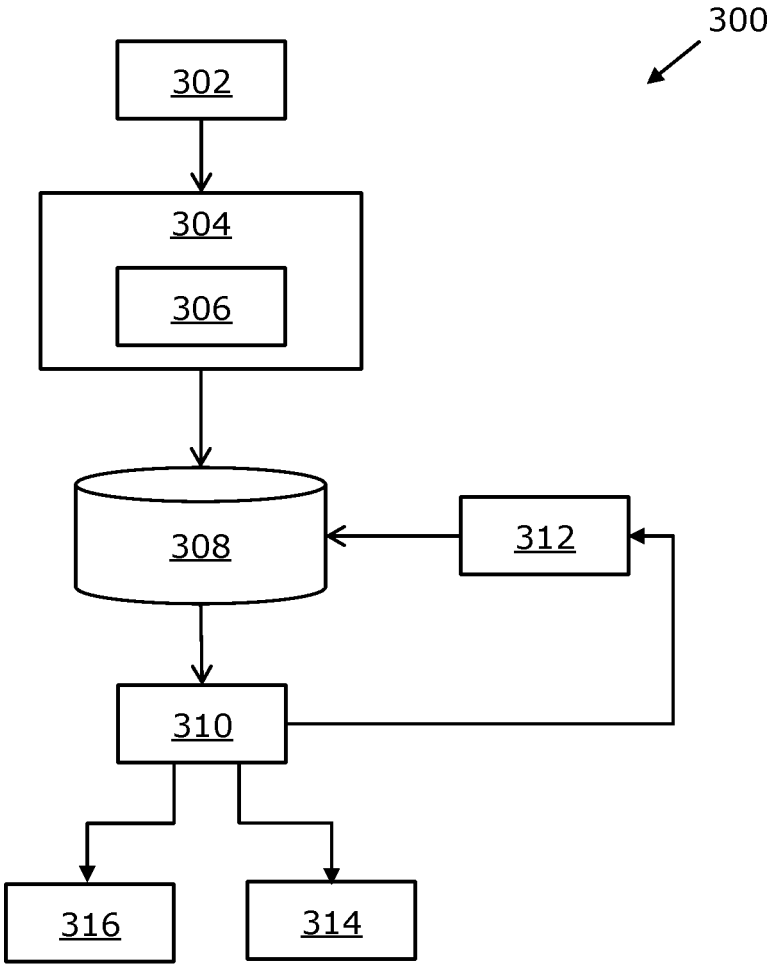
FIG. 3 is an exemplary detailed process flow for generation of a musical notation from an audio signal, in accordance with an embodiment of the present disclosure.

Referring to FIG. 3, illustrated is an exemplary detailed process flow for generation of a musical notation from an audio signal, in accordance with an embodiment of the present disclosure. At step 302, the audio signal is obtained from an audio source or a data repository. At step 304, the audio signal is processed using at least one first machine learning (ML) model to generate a recognition result, wherein the recognition result is indicative of a pitch and a duration of a plurality of notes in the audio signal and their corresponding confidence scores. At step 306, the audio signal is converted into a plurality of spectrograms having a plurality of time windows. At step 308, a preliminary musical notation is generated using the first recognition result. At step 310, the preliminary musical notation is processed using at least one second ML model to determine whether the preliminary musical notation includes one or more errors, and when it is determined that the preliminary musical notation includes one or more errors, the preliminary musical notation is modified to generate the musical notation that is error-free or has lesser errors as compared to the preliminary musical notation. At step 312, whether the confidence scores associated with the pitch and/or the duration of the sequence of notes in the at least one phrase lie below a confidence threshold is determined, and when it is determined that the confidence scores associated with the pitch and/or the duration of the sequence of notes in the at least one phrase lie below the confidence threshold, the confidence scores are updated to be greater than the confidence threshold. At step 314, the musical notation of the audio signal is generated. At step 316, an audio waveform of the audio signal is generated.

The aforementioned steps are only illustrative and other alternatives can also be provided where one or more steps are added, one or more steps are removed, or one or more steps are provided in a different sequence without departing from the scope of the claims herein.

Figure 4:
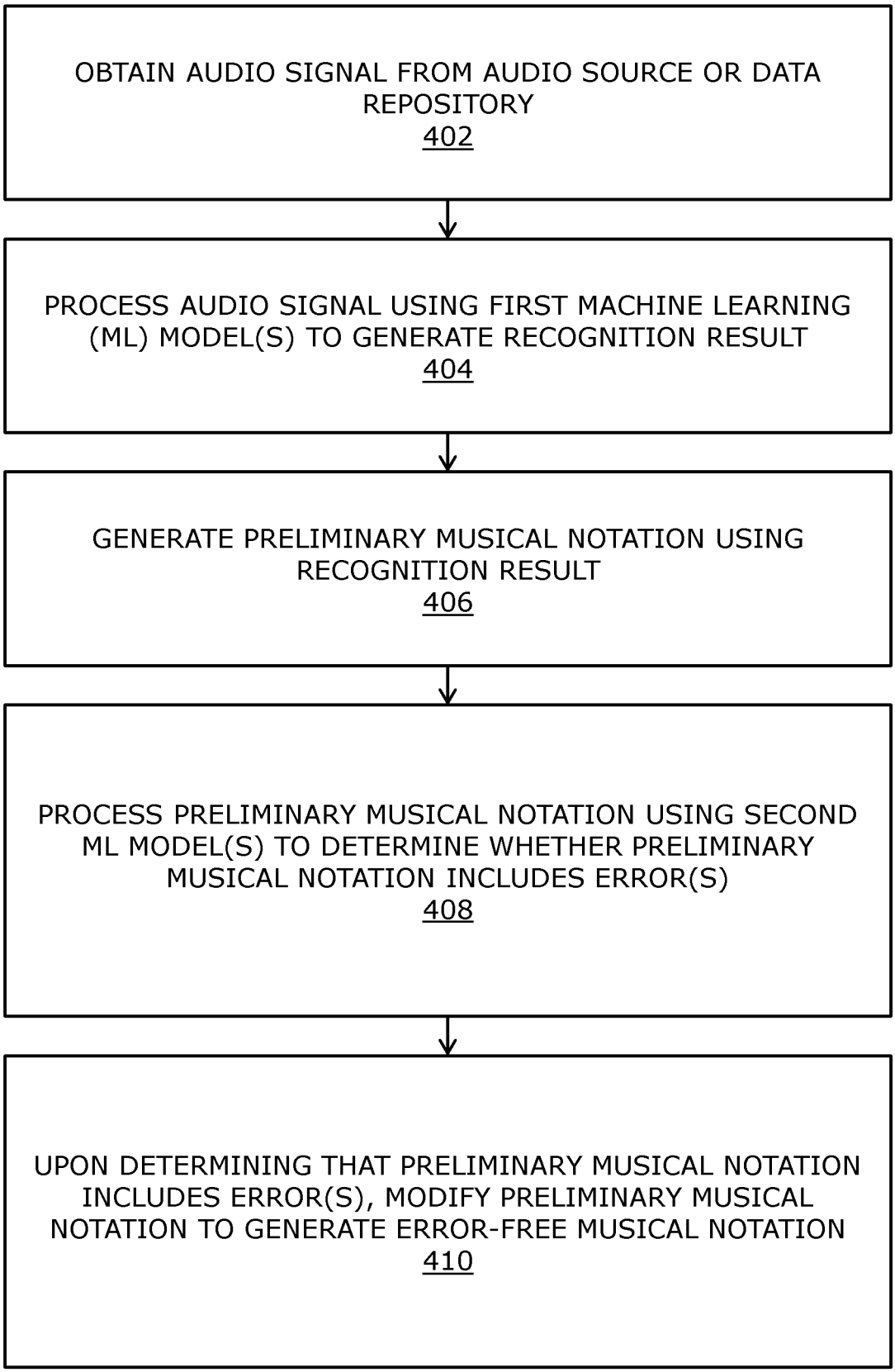
FIG. 4 is a flowchart listing steps of a method for generation of a musical notation from an audio signal, in accordance with an embodiment of the present disclosure.

Referring to FIG. 4, illustrated is a flowchart listing steps of a method for generation of a musical notation from an audio signal, in accordance with an embodiment of the present disclosure. At step 402, the audio signal is obtained from an audio source or a data repository. At step 404, the audio signal is processed using at least one first machine learning (ML) model for generating a recognition result, wherein the recognition result is indicative of a pitch and a duration of a plurality of notes in the audio signal and their corresponding confidence scores. At step 406, a preliminary musical notation is generated using the recognition result. At step 408, the preliminary musical notation is processed using at least one second ML model to determine whether the preliminary musical notation includes one or more errors. At step 410, upon determining that the preliminary musical notation includes one or more errors, the preliminary musical notation is modified for generating the musical notation that is error-free or has lesser errors as compared to the preliminary musical notation.

The aforementioned steps are only illustrative and other alternatives can also be provided where one or more steps are added, one or more steps are removed, or one or more steps are provided in a different sequence without departing from the scope of the claims herein.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

What is claimed is:

1. A system for generation of a musical notation from an audio signal, the system comprising at least one processor configured to:

generate a first training dataset that is to be employed to train at least one first ML model, wherein the first training dataset comprises at least one of: audio signals generated by at least one musical instrument, metadata of the audio signals generated by the at least one musical instrument;

train the at least one first ML model using the first training dataset and at least one ML algorithm;

obtain the audio signal from an audio source;

process the audio signal using the trained at least one first machine learning (ML) model to generate a recognition result, wherein the recognition result is indicative of a pitch and a duration of a plurality of notes in the audio signal and their corresponding confidence scores, wherein the pitch refers to a frequency of a note and wherein the duration refers to a length of a time that the note is played;

generate a preliminary musical notation using the recognition result;

process the preliminary musical notation using at least one second ML model to determine whether the preliminary musical notation includes one or more errors, wherein when processing the preliminary musical notation using the at least one second ML model, the at least one processor is configured to:

identify at least one phrase in the audio signal, based on a plurality of phrases in a plurality of audio signals belonging to a second training dataset using which the at least one second ML model is trained, wherein the at least one phrase comprises a sequence of notes that occurs between two rests;

determine whether a pitch and/or a duration of the sequence of notes in the at least one phrase mismatch with a pitch and/or a duration of notes in one or more of the plurality of phrases; and determine that the preliminary musical notation includes the one or more errors, when it is determined that the pitch and/or the duration of the sequence of notes in the at least one phrase mismatch with the pitch and/or the duration of notes in one or more of the plurality of phrases belonging to the second training dataset; and when it is determined that the preliminary musical notation includes one or more errors, modify the preliminary musical notation using the at least one second ML model, to generate the musical notation that is error-free or has lesser errors as compared to the preliminary musical notation.

2. The system according to claim 1, wherein when modifying the preliminary musical notation to generate the musical notation that is error-free or has lesser errors as compared to the preliminary musical notation, the at least one processor is configured to:

determine a required correction in the pitch and/or the duration of the sequence of notes in the at least one phrase, based on an extent of mis-match between the pitch and/or the duration of the sequence of notes in the at least one phrase and the pitch and/or the duration of notes in one or more of the plurality of phrases; and apply the required correction to the pitch and/or the duration of the sequence of notes in the at least one phrase.

3. The system according to claim 1, when it is determined that the pitch and/or the duration of the sequence of notes in the at least one phrase match with the pitch and/or the duration of notes in one or more of the plurality of phrases, the at least one processor is configured to:

determine whether confidence scores associated with the pitch and/or the duration of the sequence of notes in the at least one phrase lie below a confidence threshold; and when it is determined that the confidence scores associated with the pitch and/or the duration of the sequence of notes in the at least one phrase lie below the confidence threshold, update the confidence scores to be greater than the confidence threshold.

4. The system according to claim 1, wherein the at least one processor is further configured to detect a change in at least one of: a time signature of the preliminary musical notation, a key signature of the preliminary musical notation, a tempo marking of the preliminary musical notation, a type of the audio source, wherein upon detection of the change, the at least one processor triggers the processing of the preliminary musical notation using the at least one second ML model.

5. The system according to claim 1, wherein the at least one processor is further configured to:

generate a preliminary audio waveform of the audio signal using the recognition result; and modify the preliminary audio waveform to generate an audio waveform that is error-free or has lesser errors as compared to the preliminary audio waveform.

6. The system according to claim 1, wherein when obtaining the audio signal from the audio source, the at least one processor is configured to record the audio signal when the audio signal is played by the audio source or import a pre-recorded audio file from the data repository.

7. The system according to claim 1, wherein prior to processing the audio signal using the at least one first ML model, the at least one processor is further configured to convert the audio signal into a plurality of spectrograms having a plurality of time windows.

8. The system according to claim 1, wherein the at least one first ML model comprises a plurality of first ML models and the first training dataset comprises a plurality of subsets, each subset comprising at least one of: audio signals generated by one musical instrument, metadata of the audio signals generated by the one musical instrument, wherein each first ML model is trained using a corresponding subset.

9. A method for generating a musical notation from an audio signal, the method comprising:

generating a first training dataset that is employed for training at least one first ML model, wherein the first training dataset comprises at least one of: audio signals generated by at least one musical instrument, metadata of the audio signals generated by the at least one musical instrument;

training the at least one first ML model using the first training dataset and at least one ML algorithm;

obtaining the audio signal from an audio source;

processing the audio signal using the trained at least one first machine learning (ML) model for generating a recognition result, wherein the recognition result is indicative of a pitch and a duration of a plurality of notes in the audio signal and their corresponding confidence scores, wherein the pitch refers to a frequency of a note and wherein the duration refers to a length of a time that the note is played;

generating a preliminary musical notation using the recognition result;

processing the preliminary musical notation using at least one second ML model to determine whether the preliminary musical notation includes one or more errors, wherein the step of processing the preliminary musical notation using the at least one second ML model comprises:

identifying at least one phrase in the audio signal, based on a plurality of phrases in a plurality of audio signals belonging to a second training dataset using which the at least one second ML model is trained, wherein the at least one phrase comprises a sequence of notes that occurs between two rests;

determining whether a pitch and/or a duration of the sequence of notes in the at least one phrase mismatch with a pitch and/or a duration of notes in one or more of the plurality of phrases; and determining that the preliminary musical notation includes the one or more errors, when it is determined that the pitch and/or the duration of the sequence of notes in the at least one phrase mismatch with the pitch and/or the duration of notes in one or more of the plurality of phrases belonging to the second training dataset; and upon determining that the preliminary musical notation includes one or more errors, modifying the preliminary musical notation using the at least one second ML model for generating the musical notation that is error-free or has lesser errors as compared to the preliminary musical notation.

10. The method according to claim 9, wherein the step of modifying the preliminary musical notation for generating the musical notation that is error-free or has lesser errors as compared to the preliminary musical notation comprises:

determining a required correction in the pitch and/or the duration of the sequence of notes in the at least one phrase, based on an extent of mis-match between the pitch and/or the duration of the sequence of notes in the at least one phrase and the pitch and/or the duration of notes in one or more of the plurality of phrases; and applying the required correction to the pitch and/or the duration of the sequence of notes in the at least one phrase.

11. The method according to claim 9, wherein the method further comprises detecting a change in at least one of: a time signature of the preliminary musical notation, a key signature of the preliminary musical notation, a tempo marking of the preliminary musical notation, a type of the audio source, wherein upon detecting the change, triggering the processing of the preliminary musical notation using the at least one second ML model.

* * * * *